US006188413B1

(12) United States Patent
Kang

(10) Patent No.: US 6,188,413 B1
(45) Date of Patent: Feb. 13, 2001

(54) METHOD AND DEVICE FOR SENSING THE QUANTITY OF INK REMAINING IN AN INKJET PRINTER

(75) Inventor: Sung-Wook Kang, Seoul (KR)

(73) Assignee: SamSung Electronics Co., Ltd., Suwon (KR)

( * ) Notice: Under 35 U.S.C. 154(b), the term of this patent shall be extended for 0 days.

(21) Appl. No.: 09/144,541

(22) Filed: Aug. 31, 1998

(30) Foreign Application Priority Data

Aug. 30, 1997 (KR) ..... 97-43520

(51) Int. Cl.[7] ..... B41J 2/195
(52) U.S. Cl. ..... 347/7; 347/37
(58) Field of Search ..... 347/7, 19, 37; 399/24

(56) References Cited

U.S. PATENT DOCUMENTS

| | | | | |
|---|---|---|---|---|
| 4,935,751 | | 6/1990 | Hamlin | 347/86 |
| 4,940,997 | | 7/1990 | Hamli et al. | 347/87 |
| 4,973,993 | | 11/1990 | Allen | 347/7 |
| 5,079,570 | | 1/1992 | Mohr et al. | 347/7 |
| 5,329,373 | | 7/1994 | Hayashi et al. | 358/296 |
| 5,359,353 | | 10/1994 | Hunt et al. | 347/86 |
| 5,582,327 | | 12/1996 | De Faforcade | 222/1 |
| 5,689,289 | * | 11/1997 | Watanabe et al. | 347/7 |
| 5,713,492 | | 2/1998 | DeGennaro | 222/153.03 |
| 5,798,771 | * | 8/1998 | Nishii et al. | 347/7 |
| 5,856,833 | * | 1/1999 | Elgee et al. | 347/19 |
| 5,883,646 | * | 3/1999 | Beauchamp | 347/19 |

FOREIGN PATENT DOCUMENTS 6-106730 4/1994 (JP) .

OTHER PUBLICATIONS

Onishi, et al., "Ink Jet Recording Device", JP 406106730A, Japanese Patent Abstracts, pp. 1–2, Apr. 1994.

* cited by examiner

*Primary Examiner*—John Barlow
*Assistant Examiner*—Craig A. Hallacher
(74) *Attorney, Agent, or Firm*—Robert E. Bushnell, Esq.

(57) ABSTRACT

A method and a device for sensing the quantity of remaining ink of an ink-jet printer, the device including a memory for storing printing data from a computer, a jetting device for outputting a printed output corresponding to the printing data in the memory through an inkjetting motion, a scanning device for scanning in wider scanning width than an inkjetting width by movement in the same course, forward or returning direction, as the jetting device, the jetting device and the scanning device using the same driving unit, a picture memory for storing picture or scanning data identified through the scanning device, and a CPU for sensing the quantity of remaining ink by comparing the printing data in the print data memory with the scanning data in the picture memory.

26 Claims, 4 Drawing Sheets

METHOD AND DEVICE FOR SENSING THE QUANTITY OF INK REMAINING IN AN INKJET PRINTER

CLAIM OF PRIORITY

This application makes reference to, incorporates the same herein, and claims all benefits accruing under 35 U.S.C. §119 from my application entitled An Apparatus For Checking Ink Remains And The Method filed with the Korean Industrial Property Office on Aug. 30, 1997 and there duly assigned Serial No. P1997-43520 by that Office.

BACKGROUND OF THE INVENTION

1. Field of the Invention

The present invention relates to an inkjet printer, and more particularly to a method and a device for sensing the quantity of remaining ink by scanning and comparing print letters through a wider scanner width than a print width of an inkjet print head.

2. Description of the Related Art

A cartridge of an inkjet printer exemplary of contemporary practice in the art stores a certain quantity of ink, and forms print letters by jetting stored ink on the paper through the jetting device. After a certain period of time, the ink stored in the cartridge is consumed and is replaced and again used after being refilled. Accordingly, a manufacturer of an inkjet printer informs a user of the quantity of remaining ink and lets the user know the time for the replacement of a cartridge.

A central processing unit (CPU) inside of a printer, in order to determine the quantity of remaining ink, calculates the jetted quantity of ink by counting the number of inkdrops jetted through the head, when printing begins. After determining the value, knowing the quantity of ink stored in a cartridge as a number of drops stored in advance, and after the number of jetted inkdrops is determined through use of a counter, the two values are compared. Based on the total drop number of the quantity of ink stored in advance, the CPU judges whether the value of drops jetted through a head reaches a certain value, and if the value reaches the certain value, the CPU stops the printing motion and indicates that the ink has been totally consumed through an indicator.

Also, exemplary of contemporary practice in the art for determining the quantity of remaining ink is to check out the quantity of remaining ink by knowing the quantity of ink initially inside of an inkjet print head, then adding up the number of dots jetted through a nozzle at each time of printing, and analogizing the remaining ink based upon the initial quantity of ink and the number of dots jetted through the nozzle. Accordingly, it frequently occurs that the printer will continue to print even though a sufficient quantity of ink does not remain, because an accurate quantity of consumed ink cannot be counted. Also, on the contrary, printing stops after indicating a message for replacing a cartridge, even though ink remains. As a result, waste of paper can occur, as well as problems of inconvenience, when a printer is used.

U.S. Pat. No. 4,935,751 to Hamlin entitled Level Sensor For Ink Bag, discloses an ink device having means for determining the amount of ink remaining in an ink bag including a rigid, rectangular box which has a window in the top, a collapsible ink bag in the container, one side of the ink bag being secured to the corresponding side of the container and the opposite side of the ink bag having a rigid plate or strip secured to its lower head so that the top edge of the plate is visible through the window.

U.S. Pat. No. 4,940,997 entitled Out-Of-Ink Sensing Method, to Hamlin, et al. disclose an ink-jet printer, wherein a ball check-valve is used over the ink outlet of an ink bag to interrupt the flow of ink and/or air to the ink bladder when the ink supply in the bag falls below a predetermined level.

U.S. Pat. No. 4,973,993 entitled Ink-Quantity And Low Ink Sensing For Ink-jet Printers, to Allen, discloses means for computing remaining ink and for sensing a true low-ink and out-of-ink condition. It is disclosed ink is supplied to a printhead by an elastic bladder which is periodically refilled from an ink bag, with the bladder being designed to collapse in a repeatable manner as ink is consumed. A sensor probe is disclosed which moves along the bladder's collapse axis, dimples the bladder prior to printing to initialize the collapse mode, with the probe position along the axis being measured when its sensitive tip touches the bladder. It is disclosed the difference between the bladder positions before and after refill is used in an algorithm to compute the bladder's volumetric change to indicate the ink consumed on each print cycle, and gives the quantity of ink remaining when subtracted from an initial value.

U.S. Pat. No. 5,079,570 entitled Capillary Reservoir Binary Ink Level Sensor to Mohr, et al., disclose an ink level sensor provided for detecting a level of ink in an ink cartridge containing a capillary reservoir, such as foam, therein. It is disclosed that the ink level sensor is a binary fluidic indicator, which provides both a human and machine readable indication of the level of the ink. Various embodiments are disclosed of the ink level sensor including a two-port sensor, a one-port sensor and a pair of fluidically -connected needles of different length.

U.S. Pat. No. 5,329,373 entitled Facsimile Apparatus Having Original Document And Recording Medium Conveying Systems to Hayashi, et al., disclose a facsimile apparatus which includes a recording unit including a serial ink-jet recording head and a replaceable ink cartridge. It is disclosed the apparatus includes an upper surface lid, which is openably provided on the upper surface of the main body and allows replacement of the ink cartridge.

U.S. Pat. No. 5,359,353 entitled Spring-Bag Printer Ink Cartridge With Volume Indicator to Hunt, et al., disclose and inkjet pen supply cartridge having a spring biased ink bag with a visual indication of remaining ink quantity. It is disclosed that the spring-bag is contained in a rigid cartridge and a pair of flexible tape members are cemented or welded, one to each side of the spring-bag, and extend generally parallel toward a narrow end surface of the cartridge at which they overlap and can be viewed through a window.

SUMMARY OF THE INVENTION

An object of the present invention is to sense the quantity of remaining ink in an inkjet printer, on which a scanner module and a module of an inkjet print head are mounted.

Another object of the present invention is to identify a print letter and its density at the same time by making a scanning width wider than a print letter width.

In order to achieve the above and other objects, the present invention provides a device for sensing the quantity of ink remaining in an inkjet printer including a memory for storing the printing data received from a computer, a jetting device for outputting a printed output corresponding to the printing data in the memory through inkjetting of ink during an inkjetting motion of the jetting device, a scanning device for scanning in a wider scanning width than an inkjetting width by movement in the same course, one of a forward direction and a returning direction, as said jetting device, a picture memory for storing a picture identified by scanning data generated through scanning by the scanning device, and a central processing unit (CPU) for sensing or determining the quantity of remaining ink by comparing the printing data in the memory with the scanning data in the picture memory.

A feature of the device for sensing the quantity of remaining ink according to the present invention is that the whole inkjetting width is so constituted as to be included in the inside of the scanning width of a scanning device, with the scanning device and a jetting device being constituted as to operate at the same time by a driving unit of the device.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DETAILED DESCRIPTION OF PREFERRED EMBODIMENTS

It will be apparent to those skilled in the art that various modifications can be made in the present invention, without departing from the spirit of the invention. Thus, it is intended that the present invention cover such modifications, as well as variations thereof, within the scope of the appended claims and their equivalents.

Figure 1:
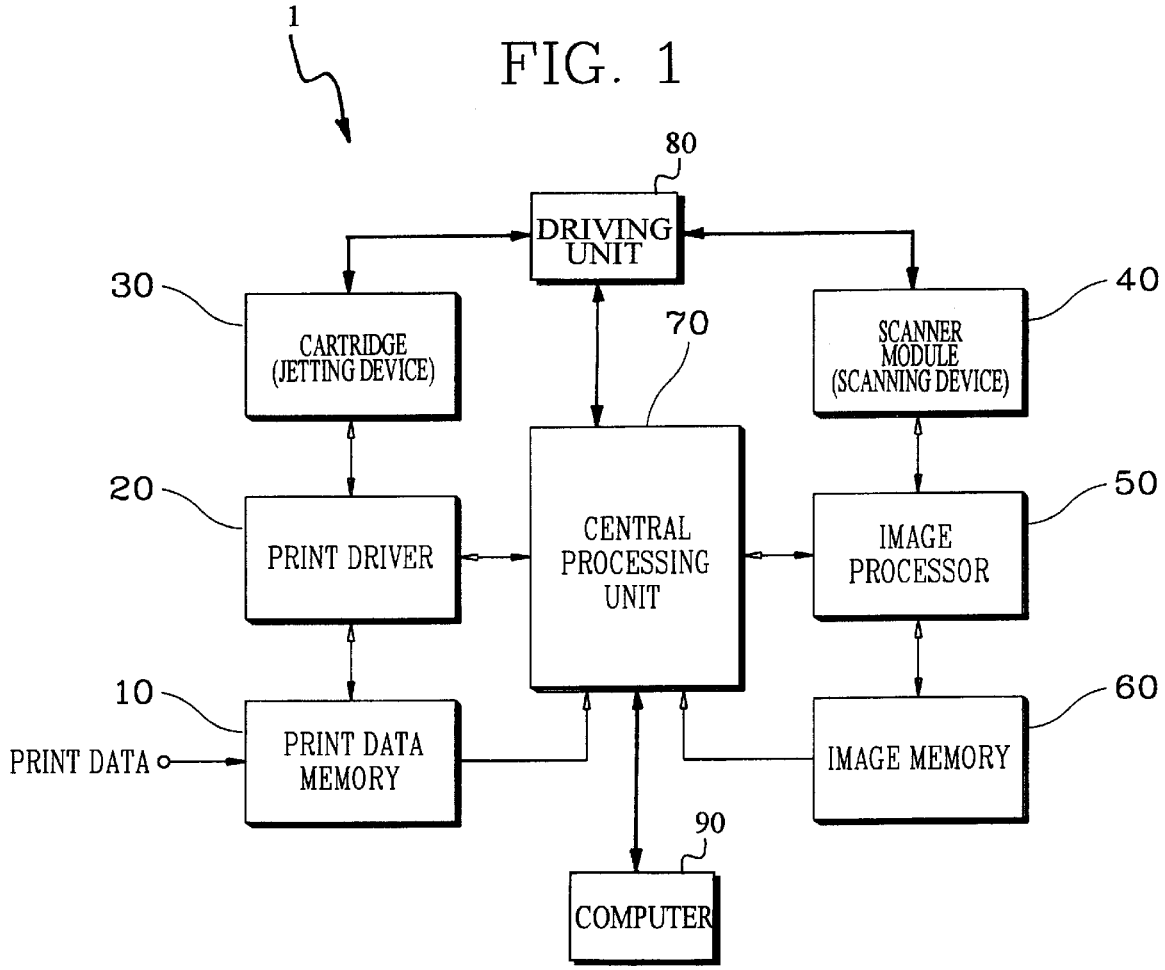
FIG. 1 is a diagram illustrating an embodiment of an inkjet printer and a device for sensing the quantity of remaining ink according to the present invention.

Referring to FIG. 1, FIG. 1 is a diagram illustrating an embodiment of an inkjet printer 1 according to the present invention. The inkjet printer 1 includes a print data memory 10 for storing the printing data received from a computer 90, a print driver 20 for controlling the carrying out of the printing of the printing data stored inside of the print data memory 10 print data through the cartridge or jetting unit 30, a scanner module or scanning device 40 for scanning an image by movement in the same course, forward or returning direction, as the cartridge 30 driven by the same driving unit 80, a picture or image processor 50 for storing in the picture or image memory 60 by processing a picture and corresponding scanning data identified through a scanner module or scanning device 40, and a central processing unit (CPU) 70, for sensing or determining the quantity of remaining ink by comparing printing data inside of the print data memory 10 and the scanning data inside of the picture memory 60.

An example of sensing or determining the quantity of remaining ink according to the present invention using an embodiment of the ink jet printer 1 of FIG. 1 as described above, is carried out as follows. A print order from computer 90 is transmitted to the CPU 70, and at the same time, printing data are transmitted to the print data memory 10, such as from computer 90. Print driver 20, upon receiving a print control signal from CPU 70, forms a print letter or letters through the jetting motion of cartridge or jetting device 30. Scanning motion is carried out by the scanner module or scanning device 40 by movement in the same course, forward or returning direction, as jetting device or cartridge 30 driven by the same driving unit 80, and the picture and scanning data identified through scanner module 40 is transmitted to CPU 70 and picture memory 60. CPU 70 can then discern if it is time for replacement of ink, by the CPU 70 comparing the printing data stored in print data memory 10 and the scanning data stored in picture memory 60, and the difference of scanning level between these two data over an established area providing an indication or the need for replacement of ink for the jetting device or cartridge 30.

Figure 2:
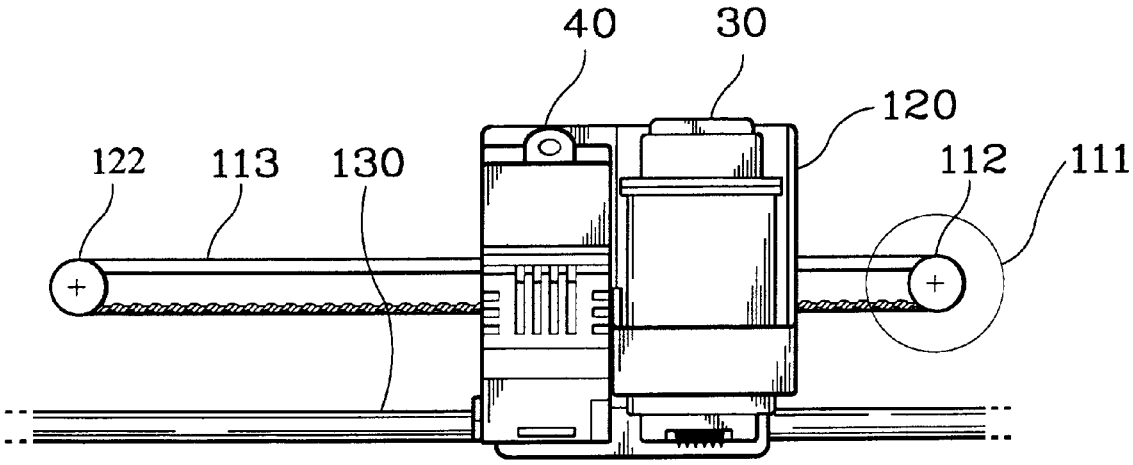
FIG. 2 is a an illustration of the driving unit for the jetting device and the scanning device of FIG. 1.

FIG. 2 is a view illustrating the driving unit 80 of cartridge or jetting device 30 and scanning device 40 of FIG. 1. Referring to FIG. 2, driving unit 80 includes a motor 111 for offering a driving force for moving the cartridge or the jetting device 30 and the scanning device or scanning module 40, plural pulleys 112 and 122 for conveying the rotatory power of the motor 111 and a belt 113, driven by a driving force offered to the two pulleys 112 and 122. Driving unit 80 also includes a carrier 120, moving to the left and right according to movement of the belt 113 through connection to belt 113, and a shaft 130 for guiding movement to the left and right of the carrier 120, with the scanner module or scanning device 40 and the jetting device or cartridge 30 mounted on the carrier 120.

Figure 3:
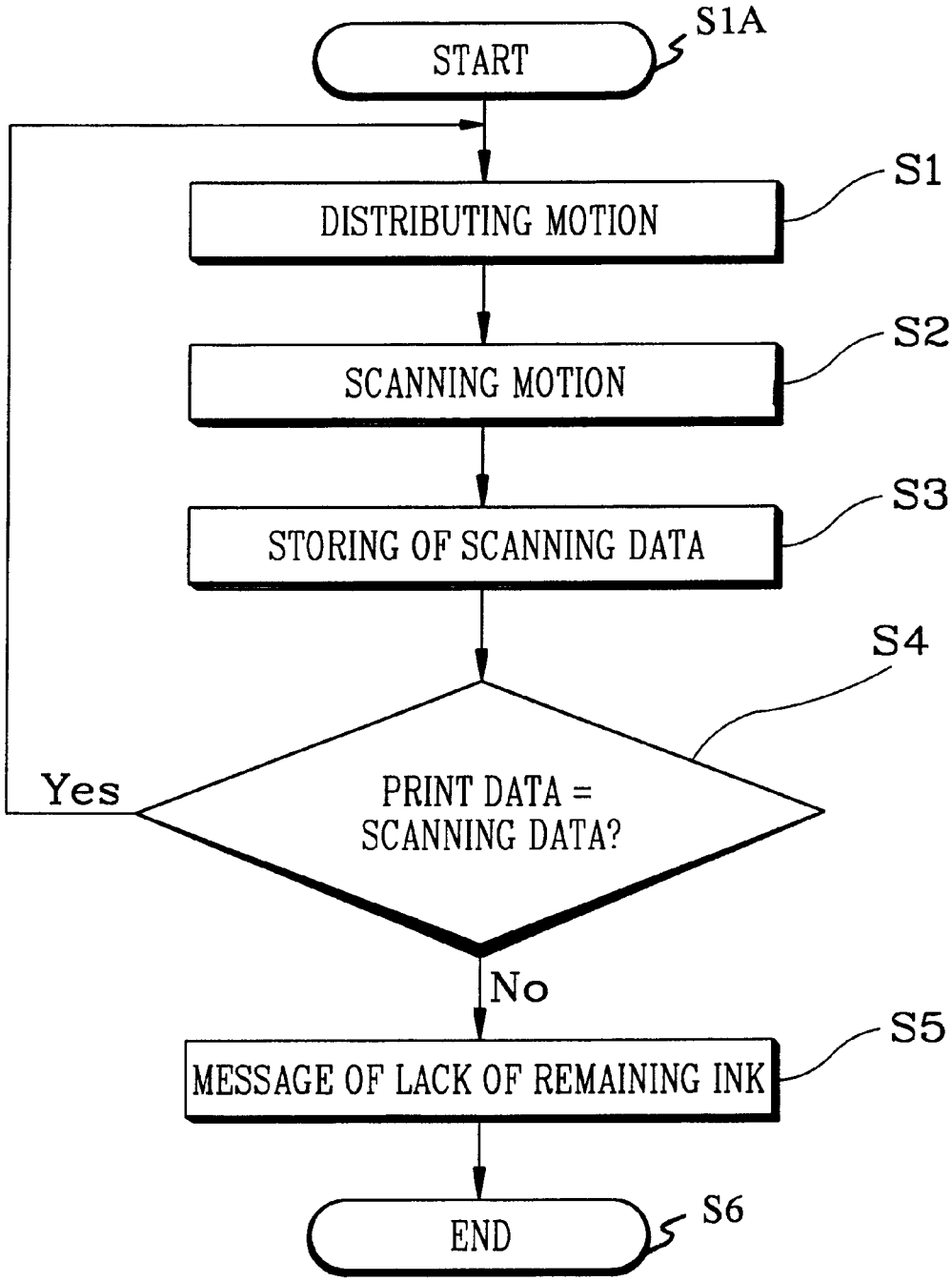
FIG. 3 is a flow diagram illustrating a sensing method for determining the quantity of remaining ink according to the present invention.
Figure 4:
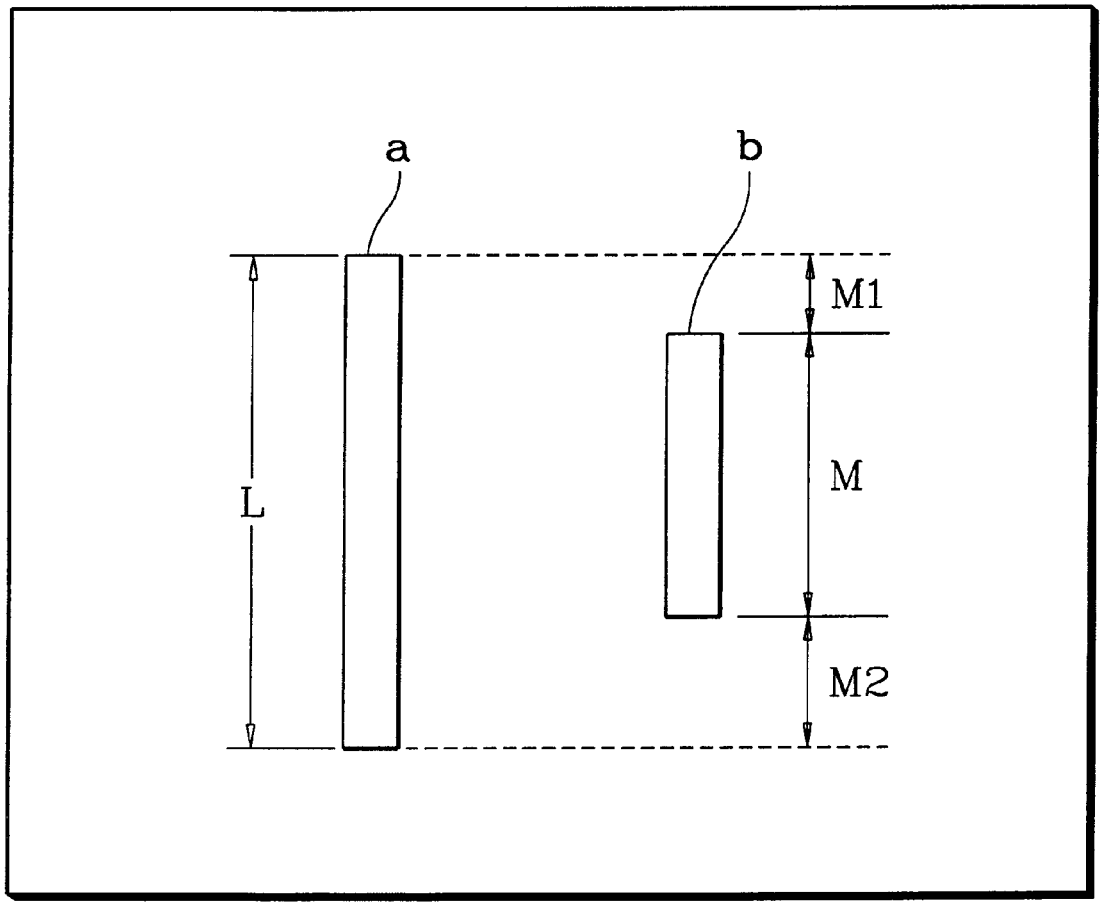
FIG. 4 is a view comparing print letter or inkjetting width and scanning width of an inkjet printer according to the present invention.

The method and operation of the present invention is illustrated by the flow diagram of FIG. 3 and with reference to FIG. 4. Referring to FIG. 3, the process starts at step S1A. The process then proceeds to step S1 when the inkjet printer 1 prints a printed output corresponding to the printing data in the print data memory 10, received from computer 90 according to the print motion order, through the jetting device 30.

The process then proceeds to step S2 where scanning device or module 40 scans a wider area than a print area by movement in the same course, forward or returning direction, as jetting device 30. In this regard, FIG. 4 illustrates a scanning width of scanning device or scanner module 40 and a print or inkjetting width being jetted through the cartridge head of jetting device 30. As illustrated in FIG. 4, the length of scanning width of slit "a" formed in the lower part of scanning device or scanner module 40 is identified by the letter "L", and the length of the print or inkjetting width being jetted through head "b" positioned in the lower part of jetting device or cartridge 30 is identified by the letter "M". The difference between the length of the two widths L and M is the value M1+M2 comprised of adding the upper difference M1 and the lower difference M2.

When the difference between the two widths, the scanning width L and the print or inkjetting width M, is greater than or equal to an established value, the jetting motion of step S1 and the scanning motion of step S2 are carried out at the same time. The established value is a predeterminated value and the established value is used in controlling the scanning motion of scanning device or scanner module 40 and the jetting motion of jetting device 30 through CPU 70. When the difference of the two widths M1+M2 is smaller than the established value, the scanning motion in step S2 of scanning module 40 is carried out, in course, when the cartridge 30 returns after the jetting motion in step S1. In an example of the present invention, the scanning width L is typically sufficiently larger than print or inkjetting width M.

The process then proceeds to step S3 where scanning data scanned through the scanning process by scanning device or scanning module 40 in step S2 are stored in the picture or image memory 60 by the picture or image processor 50. The process then proceeds to step S4 where the CPU 70 senses or determines the quantity of remaining ink by comparing the image data or scanning data in the picture or image memory 60 with the black level of printing data stored in the print data memory 10. When print data or printing data in the print data memory 10 is in accord with or equal to the black level of image data or scanning data in picture or image memory 60, the quantity of ink is regarded as sufficient and the process returns to step S1. However, when a difference between the printing data in print data memory 10 and the scanning data in image or picture memory 60 occurs, it means there is a lack of quantity of ink and the process proceeds to step S5 where a user is informed that it is time for replacement of the ink cartridge. The process then ends at step S6.

As shown in the above discussion, the present invention has the ability to sense or determine the quantity of remaining ink by identifying the image printed through the jetting device 30 with use of the scanning device 40, in an inkjet printer, on which the jetting device 30 and the scanning device 40 are mounted.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Thereof, it is intended that the present invention not be limited to the particular embodiments disclosed as the best mode contemplated for carrying out the present invention, but that the present invention includes all embodiments falling within the scope of the appended claims.

What is claimed is:

1. A device for determining a quantity of ink remaining in an inkjet printer, comprising:

a print data memory for storing printing data for a printing operation;

a jetting device for outputting a printed output corresponding to said printing data stored in said print data memory through an inkjetting motion of said jetting device in a direction to define an inkjetting width;

a scanning device for scanning in an wider scanning width than said inkjetting width, said scanning device for generating scanning data corresponding to said printed output for said printing data generated by said inkjetting motion of said jetting device by movement in one of a forward direction and a returning direction as said jetting device;

a picture memory for storing said scanning data identified through movement of said scanning device, said scanning data stored in said picture memory corresponding to said printed output for said printing data; and a processing unit for determining a quantity of remaining ink by comparing said printing data stored in said print data memory with said scanning data stored in said picture memory.

2. The device as claimed in claim 1, further comprised of all of said inkjetting width of said jetting device being covered by said scanning width of said scanning device.

3. The device as claimed in claim 2, further comprised of when said printing data equals said scanning data said quantity of remaining ink is sufficient.

4. The device as claimed in claim 2, further comprised of a difference between said scanning width and said inkjetting width being at least equal to a predetermined value.

5. The device as claimed in claim 2, further comprised of said scanning device scanning said printed output of said jetting device at the same time as said jetting device operates.

6. The device as claimed in claim 5, further comprised of the difference between said scanning width and said inkjetting width being at least equal to a predetermined value.

7. The device as claimed in claim 5, further comprised of the difference between said scanning width and said inkjetting width being greater than a predetermined value.

8. The device as claimed in claim 7, further comprised of when said printing data is equal to said scanning data said quantity of remaining ink is sufficient.

9. The device as claimed in claim 5, further comprised of when said scanning data is equal to said printing data said quantity of remaining ink is sufficient.

10. The device as claimed in claim 1, further comprised of said scanning device scanning said printed output of said jetting device in said returning direction after said inkjetting motion of said jetting device in said forward direction.

11. The device as claimed in claim 10, further comprised of a difference between said scanning width and said inkjetting width being less than a predetermined value.

12. The device as claimed in claim 11, further comprised of when said scanning data is equal to said printing data said quantity of remaining ink is sufficient.

13. The device as claimed in claim 10, further comprised of when said scanning data is equal to said printing data said quantity of remaining ink is sufficient.

14. The device as claimed in claim 1, further comprising a driving unit for selectively moving said jetting device and said scanning device in said forward direction and in said returning direction.

15. The device as claimed in claim 14, further comprised of when said scanning data is equal to said printing data said quantity of remaining ink is sufficient.

16. The device as claimed in claim 15, further comprised of said processing unit comprising a central processing unit (CPU).

17. The device as claimed in claim 14, further comprised of said processing unit comprising a central processing unit (CPU).

18. The device as claimed in claim 17, further comprised of all of said inkjetting width of said jetting device being covered by said scanning width of said scanning device.

19. The device as claimed in claim 18, further comprised of said scanning device scanning said printed output of said jetting device at the same time as said jetting device operates.

20. The device as claimed in claim 17, further comprised of said scanning device scanning said printed output of said jetting device in said returning direction after said inkjetting motion of said jetting device in said forward direction.

21. A method for determining a quantity of ink remaining in an inkjet printer, comprising the steps of:

storing printing data for a printing operation in a print data memory;

outputting a printed output from a jetting device corresponding to said printing data stored in said print data memory by moving said jetting device in a direction to define an inkjetting width;

scanning in a wider scanning width than said inkjetting width by a scanning device, said scanning device moving in one of a forward direction and a returning direction as said jetting device to generate scanning data corresponding to said printed output for said printing data generated by said jetting device;

storing said scanning data corresponding to said printed output for said printing data identified through movement of said scanning device in a picture memory; and determining a quantity of remaining ink by comparing said printing data stored in said print data memory with said scanning data stored in said picture memory.

22. The method as claimed in claim 21, further comprised of when said scanning data is equal to said printing data said quantity of remaining ink is sufficient.

23. The method as claimed in claim 21, further comprised of said scanning by said scanning device being carried out at the same time as said jetting device operates.

24. The method as claimed in claim 23, further comprised of when said scanning data is equal to said printing data said quantity of remaining ink is sufficient.

25. The method as claimed in claim 23, further comprised of a difference between said scanning width and said inkjetting width being greater than a predetermined value.

26. The method as claimed in claim 25, further comprised of when said scanning data is equal to said printing data said quantity of remaining ink is sufficient.

* * * * *